US011440723B2

(12) United States Patent
Reinhart et al.

(10) Patent No.: US 11,440,723 B2
(45) Date of Patent: Sep. 13, 2022

(54) SEALING LID AND TOTE COMBINATION

(71) Applicant: CREATIVE PLASTIC CONCEPTS, LLC, Sycamore, OH (US)

(72) Inventors: Nickolas Reinhart, Findlay, OH (US); Jacob H. Whitta, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 277 days.

(21) Appl. No.: 16/585,685

(22) Filed: Sep. 27, 2019

(65) Prior Publication Data

US 2020/0102135 A1 Apr. 2, 2020

Related U.S. Application Data

(60) Provisional application No. 62/738,267, filed on Sep. 28, 2018.

(51) Int. Cl.
*B65D 81/26* (2006.01)
*B65D 1/22* (2006.01)

(52) U.S. Cl.
CPC ..... *B65D 81/261* (2013.01); *B65D 1/22* (2013.01)

(58) Field of Classification Search
CPC ..... B65D 81/261; B65D 43/0216; B65D 43/0222; B65D 2543/00462; B65D 2543/00537
See application file for complete search history.

(56) References Cited

U.S. PATENT DOCUMENTS

| | | | | |
|---|---|---|---|---|
| 3,311,257 | A | 3/1967 | Puente | |
| 3,447,714 | A | 6/1969 | Elliot | |
| 4,674,665 | A * | 6/1987 | Van Kirk | B60R 9/00 206/349 |
| D648,538 | S | 11/2011 | Reinhart et al. | |
| 8,342,329 | B2 | 1/2013 | Kobilarcik et al. | |
| D743,171 | S | 11/2015 | Reinhart | |
| D744,239 | S | 12/2015 | Reinhart | |
| D744,240 | S | 12/2015 | Reinhart | |
| D756,652 | S | 5/2016 | Reinhart | |
| D765,397 | S | 9/2016 | Reinhart | |
| D765,407 | S | 9/2016 | Reinhart | |
| D765,408 | S | 9/2016 | Reinhart | |
| D765,409 | S | 9/2016 | Reinhart | |
| D765,410 | S | 9/2016 | Reinhart | |
| D765,411 | S | 9/2016 | Reinhart | |
| D766,577 | S | 9/2016 | Reinhart | |
| D768,385 | S | 10/2016 | Reinhart | |
| D773,821 | S | 12/2016 | Reinhart | |

(Continued)

*Primary Examiner* — Andrew T Kirsch
(74) *Attorney, Agent, or Firm* — Jacob M. Ward; Ward Law Office LLC

(57) ABSTRACT

A tote assembly has a tote and a lid. The tote has a sealing channel formed in a lip that extends around a perimeter of a tote opening. At least one drain is formed in the lip and is adapted to direct a fluid away from the sealing channel. The lid has a center portion, a collar disposed around the center portion forming a perimeter of the lid, and a sealing rib formed in the collar that extends around the perimeter of the lid. The collar forms an interference fit with the lip of the tote. The sealing rib is configured to be disposed in the sealing channel to form a fluid tight seal. The fluid-tight seal between the tote and lid ensures the contents of the tote remain dry in an otherwise wet environment or conditions.

18 Claims, 8 Drawing Sheets

(56) References Cited

U.S. PATENT DOCUMENTS

| | | | |
|---|---|---|---|
| D776,932 | S | 1/2017 | Reinhart |
| D792,105 | S | 7/2017 | Reinhart |
| D794,958 | S | 8/2017 | Reinhart |
| D816,492 | S | 5/2018 | Reinhart |
| D834,315 | S | 11/2018 | Reinhart |
| D836,914 | S | 1/2019 | Reinhart |
| D838,982 | S | 1/2019 | Reinhart |
| 10,399,748 | B2 | 9/2019 | Reinhart |
| 2018/0339820 | A1 | 11/2018 | Reinhart et al. |
| 2019/0092524 | A1 | 3/2019 | Reinhart et al. |

* cited by examiner

SEALING LID AND TOTE COMBINATION

CROSS-REFERENCE TO RELATED APPLICATIONS

This application claims the benefit of U.S. Provisional Application Ser. No. 62/738,267, filed on Sep. 28, 2018. The entire disclosure of the above application is hereby incorporated herein by reference.

FIELD

The present disclosure relates generally to storage totes and, more specifically, to a sealable, waterproof, tote and lid for dry storage of items.

BACKGROUND

Storage totes and lids are often utilized for organizing and storing industrial, household and personal items. It is common to place storage totes in damp or wet areas such as basements, garages, storage units, warehouses and the outdoors.

Often these storage totes, and the contents stored within, sit for long periods of time. In this time, the contents can be easily damaged or ruined if moisture or water accumulates in the storage totes. Unfortunately, traditional storage totes and lids are limited in their ability to militate against moisture or water entering the storage totes and wetting or otherwise destroying the contents being stored.

For example, known totes are described in U.S. Pat. No. 3,447,714 to Elliot, which is directed to a container, and more particularly to a stackable, plastic container lid. Similarly, U.S. Pat. No. 3,311,257 to Puente relates to a stackable tote box. In a further example, U.S. Pat. No. 8,342,329 to Kobilarcik et al. describes a stackable storage bin and removable lid that may lock together with another storage bin and lid when stacked vertically.

These known tote and lid systems do not have features that militate against moisture or water entering the tote and ruining the contents therein. More specifically, the known tote and lid systems do not have features that direct moisture or water away from the opening of the tote, or otherwise prevent moisture or water from accumulating at or near the seal between the tote and lid.

There is a continuing need for a storage tote and lid combination with features that ensure the contents of the tote remain dry in moist or wet conditions.

SUMMARY

In concordance with the instant disclosure, a storage tote and lid combination with features that ensure the contents of the tote remain dry in moist or wet conditions, has been surprisingly discovered.

In one embodiment, a tote includes a hollow main body with a front wall, a rear wall, a first sidewall, a second sidewall, and a base wall. The tote also includes a lip extending laterally out from the front wall, the rear wall, the first sidewall, and the second sidewall of the hollow main body. The lip defines a perimeter of an opening at an end of the hollow main body that is opposite the base wall. A sealing channel is formed in the lip and extends around the perimeter of the opening. At least one drain is formed in the lip and is adapted to direct a fluid away from the sealing channel.

In another embodiment, a lid includes a center portion and a collar disposed around the center portion forming a perimeter of the lid. The collar has a top surface and a side surface extending downward from the top surface. A sealing rib formed in the collar extends around the perimeter of the lid.

In yet another embodiment, a tote assembly includes a hollow main body with a front wall, a rear wall, a first sidewall, a second sidewall, a base wall, and a lip extending laterally out from the front wall, the rear wall, the first sidewall, and the second sidewall. The lip defines a perimeter of an opening at an end of the hollow main body that is opposite the base wall. A sealing channel formed in the lip extends around the perimeter of the opening. At least one drain is formed in the lip and is adapted to direct a fluid away from the sealing channel. The tote assembly also includes a lid with a center portion, a collar disposed around the center portion forming a perimeter of the lid, and a sealing rib formed in the collar that extends around the perimeter of the lid. The collar forms an interference fit with the lip of the tote, and the sealing rib is configured to be disposed in the sealing channel to form a fluid tight seal.

DRAWINGS

The above, as well as other advantages of the present disclosure, will become readily apparent to those skilled in the art from the following detailed description, particularly when considered in the light of the drawings described hereafter.

DETAILED DESCRIPTION

The following detailed description and appended drawings describe and illustrate various embodiments of the invention. The description and drawings serve to enable one skilled in the art to make and use the invention and are not intended to limit the scope of the invention in any manner.

A tote assembly 2 according to various embodiments of the present disclosure is shown in FIGS. 1-10. The tote assembly 2 includes a tote 4 and a lid 6. The tote 4 and lid 6 are configured to fit together, in operation, and form a substantially fluid-tight seal therebetween. The fluid-tight seal likewise ensures the contents disposed within the tote assembly 2 remain dry by militating against moisture and fluid transfer from the environment outside the tote 4 to the inside of the tote 4 over time.

Figure 1:
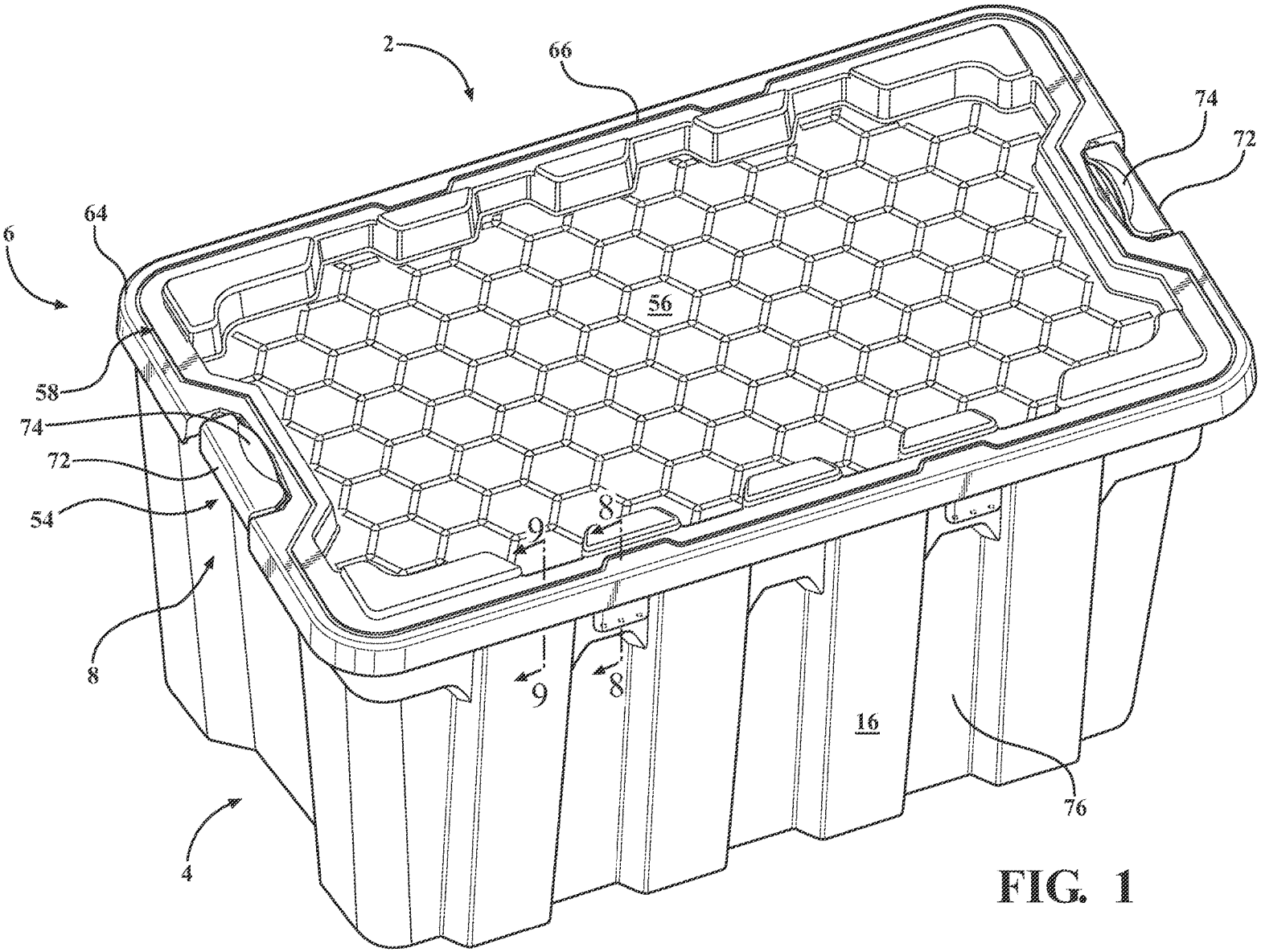
FIG. 1 is a top perspective view of the tote assembly according to one embodiment of the present disclosure.
Figure 2:
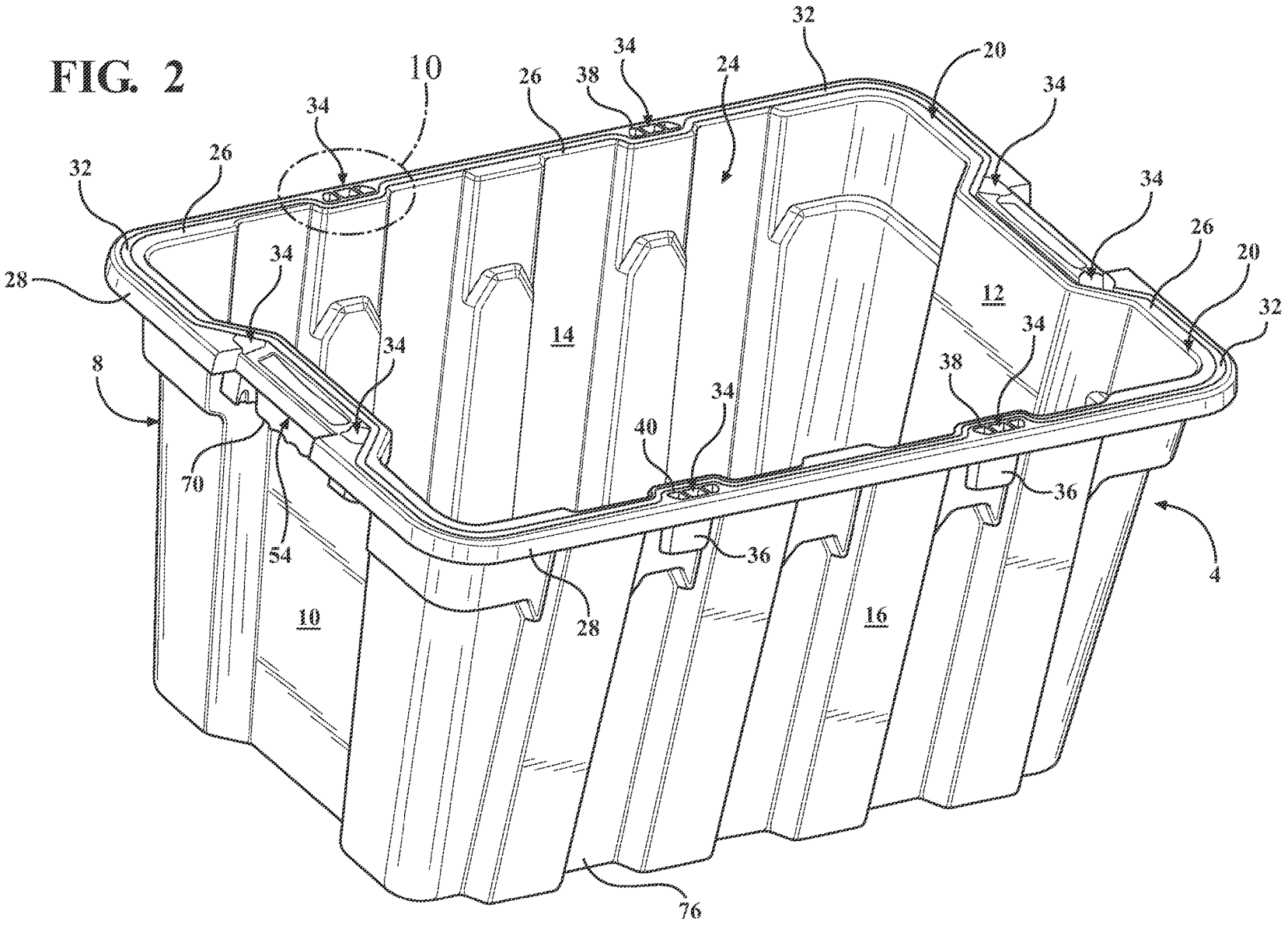
FIG. 2 is a top perspective view of a tote of the tote assembly shown in FIG. 1, the tote shown without a lid.

With reference to FIGS. 1-4, the tote 4 according to one embodiment may have a main body 8 with a front wall 10, a rear wall 12, a first sidewall 14, a second sidewall 16, and a base wall 18. The main body 8 of the tote 4 has a lip 20, as shown in FIG. 2. The lip 20 forms a perimeter that defines an opening 22 opposite the base wall 18. The front wall 10, the rear wall 12, the first sidewall 14, the second sidewall 16, and the base wall 18 together define a cavity 24 in the main body 8. The cavity 24 is a hollow volume that may be used for storing items.

Figure 4:
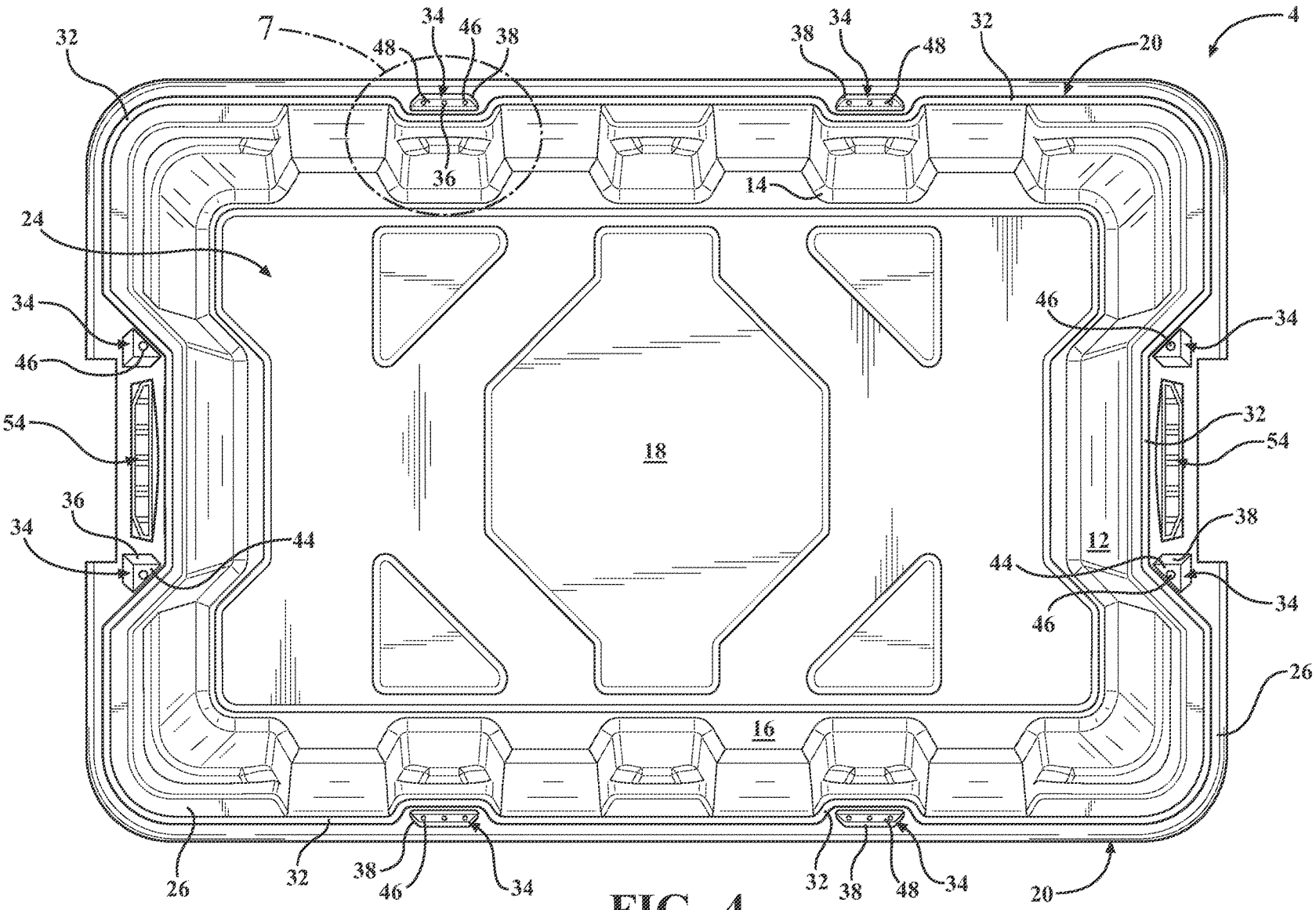
FIG. 4 is a top plan view of the tote shown in FIG. 2, and further illustrating a sealing channel and a plurality of drains disposed around a perimeter of the tote.

Referring to FIGS. 2 and 4, the lip 20 of the tote 4 has a top surface 26, a side surface 28, lip supports 30, and a sealing channel 32. The top surface 26 of the lip 20 is disposed adjacent to, and extends laterally outward from, each of the front wall 10, the rear wall 12, the first sidewall 14, and the second sidewall 16. The lip supports 30 may be connected to one or both of the top surface 26 and the side surface 28 of the lip 20 and to one of the front wall 10, the rear wall 12, the first sidewall 14, and the second sidewall 16. The lip supports 30 provide support and stability for the top surface 26 and the side surface 28 of the lip 20 when storing, stacking, and moving the tote assembly 2.

Figure 8:
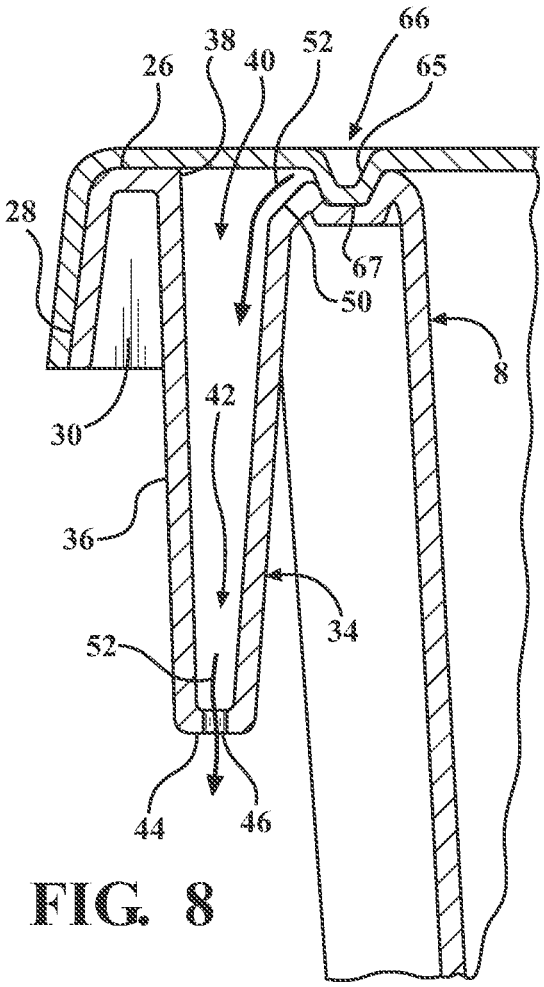
FIG. 8 is an enlarged cross-sectional side elevational view of the drain of the tote taken at section line 8-8 in FIG. 1.
Figure 9:
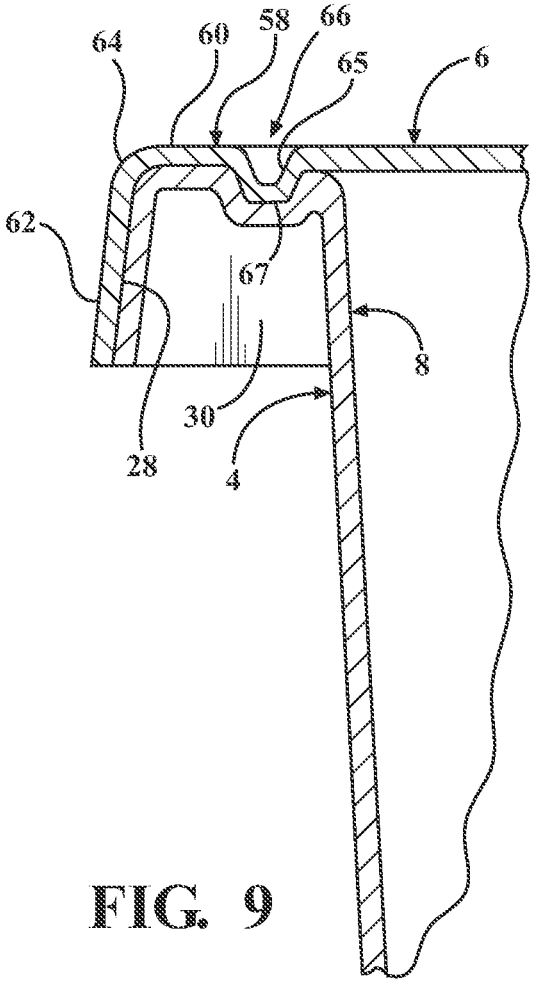
FIG. 9 is an enlarged section view of the sealing channel and sealing rib of the tote and lid assembly taken at section line 9-9 in FIG. 1.

The sealing channel 32 is formed in the top surface 26. As shown in FIGS. 2 and 4, the sealing channel 32 extends around the top surface 26 of the lip 20, thereby forming a complete loop circumscribing the cavity 24. In certain examples, as shown in FIGS. 8-9, the sealing channel 32 may be defined by a concave portion of the top surface 26 of the lip 20. The concave portion of the top surface 26 defining the sealing channel 32 may have an arc shape in cross section, or may have rounded or squared corners, as desired. The sealing channel 32 may also be supported by the lip supports 30, in certain embodiments.

Figure 3:
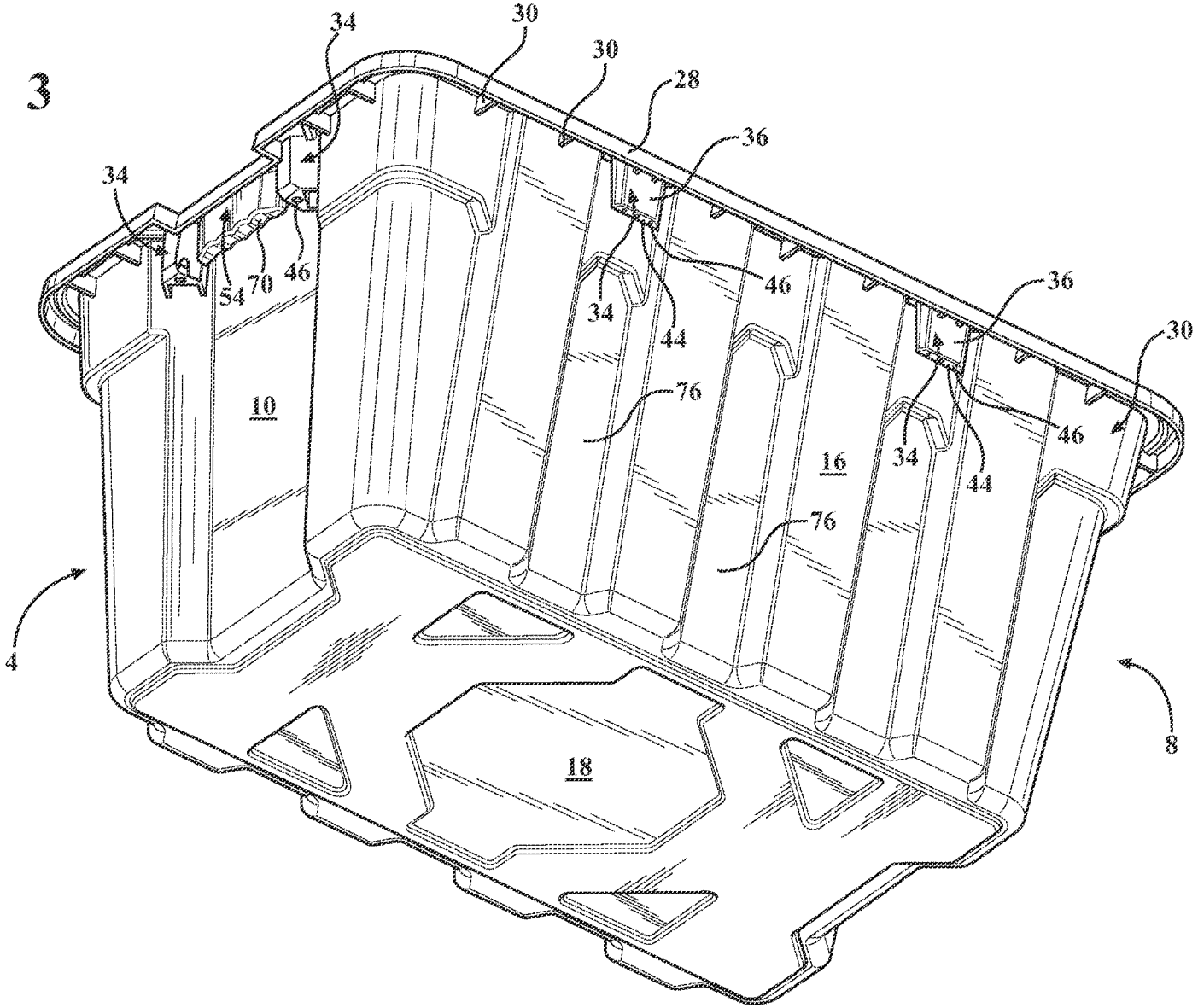
FIG. 3 is a bottom perspective view of the tote shown in FIG. 2.
Figure 7:
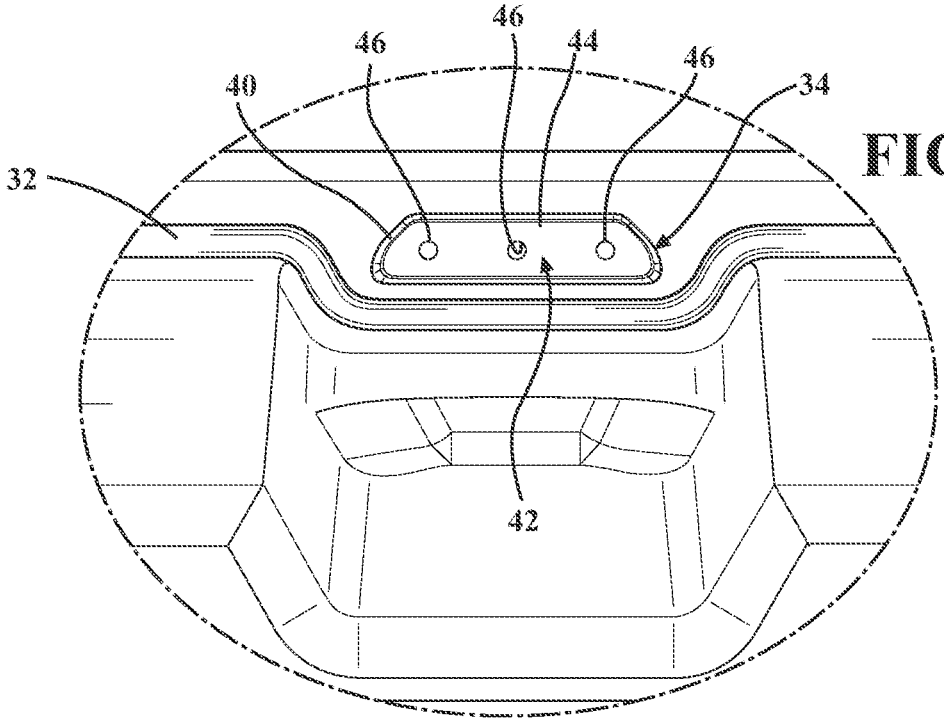
FIG. 7 is an enlarged fragmentary top plan view of a drain disposed in the lip of the tote taken at call-out 7 in FIG. 4.

In particular embodiments, as shown in FIGS. 3-4 and 7, at least one drain 34 is further formed within the top surface 26 of the lip 20. The at least one drain 34 has a funneling wall 36 that extends downward from a rim 38. The funneling wall 36 is generally funnel-shaped, for example, and is configured to collect fluid from the top surface 26 of the lip 20 and direct the fluid away from the top surface 26 of the lip 20. The rim 38 defines an opening 40 in the top surface 26 of the lip 20. The opening 40 of the drain 34 leads to a drainage passageway 42, which is defined by the funneling wall 36 and a base wall 44.

With continued reference to FIGS. 3-4 and 7, the base wall 44 has at least one aperture 46 formed therethrough. The drainage passageway 42 is adapted to direct moisture or water away from the sealing channel 32, down the funneling wall 36 to the base wall 44, and out the aperture 46. An inner surface of the base wall 44 may also be formed so as to slope towards the aperture 46, in order to further direct moisture or water out of the drain 34. The drain 34 may also be supported by one or more lip supports 30, in certain embodiments.

Figure 10:
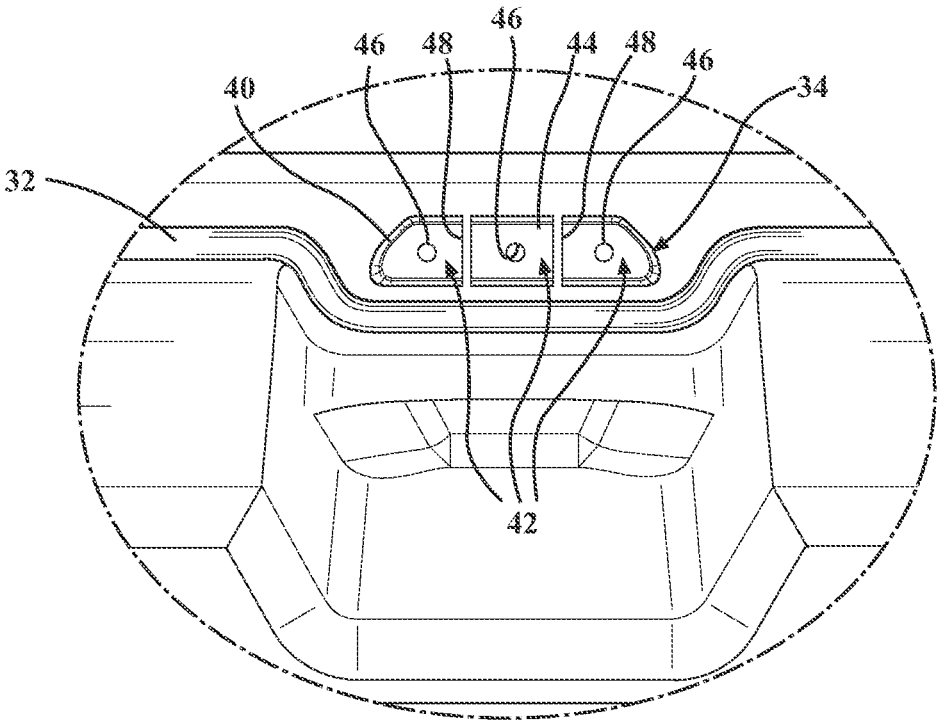
FIG. 10 is an enlarged fragmentary top plan view of a drain disposed in the lip of the tote taken at call-out 10 in FIG. 2.

In a further embodiment, as shown in FIG. 10, the drain 34 may have one or more partitions 48. The partitions 48 may divide the drain 34 into two or more separate drainage passageways 42, in order to more effectively direct moisture or water away from the sealing channel 32. The partitions 48 may also add rigidity to the funneling wall 36. Each of the drainage passageways 42 formed by the partitions 48 leads to one or more of the apertures 46 to allow for moisture or water to exit the drain 34.

In yet another embodiment, as shown in FIG. 8, the top surface 26 of the lip 20 may have a sloping edge 50. The sloping edge 50 is angled downwardly from the top surface 26, toward the base wall 44, and further directs moisture or water along a fluid path 52 that leads away from the sealing channel 32, down the funneling wall 36 of the drain 34, and out the aperture 46. In operation, where the lid 6 is placed atop the tote 4, any moisture or water that may have collected within the sealing channel 32 may be pushed outwardly and directed down the funneling wall 36 by the sloping edge 50 of the top surface 26 adjacent to the sealing channel 32.

Certain embodiments of the present disclosure, for example, as shown in FIGS. 2-4, may have more than one drain 34 disposed in the top surface 26 of the lip 20. The plurality of drains 34 may be disposed adjacent one or more of the front wall 10, the rear wall 12, the first sidewall 14, and the second sidewall 16. Additionally, each of the drains 34 may have varying or different numbers of the drainage passageways 42. Each or the drains 34 may likewise have varying or different numbers of the apertures 46.

Alternatively, all of the drains 34 may be provided with a same structure. For example, as shown in FIGS. 2-4, there may be a total of eight (8) drains 34 disposed along the lip 20, including two (2) adjacent each of the front wall 10, the rear wall 12, the first sidewall 14, and the second sidewall 16. Other suitable numbers and placements of the drains 34 may also be sued within the scope of the present disclosure, as desired.

As illustrated in FIGS. 3-4, the drains 34 are disposed adjacent to each of the front wall 10 and the rear wall 12 may also each be disposed adjacent to a tote handle portion 54 also disposed in the lip 20 of the tote 4 and include one drainage passageway 42 and one aperture 46. The drains 34 disposed in the lip 20 adjacent the first sidewall 14 and second sidewall 16 may each have three drainage passageways 42 leading to three apertures 46. It should be appreciated that other suitable configurations for the drains 34 may also be chosen by a skilled artisan within the scope of the present disclosure.

As shown in FIG. 4, the sealing channel 32 is disposed proximal to the opening 22 of the tote 4 with respect to the drains 34. In particular, the sealing channel 32 is located such that the drains 34 are in position to direct water away from the sealing channel 32, along the drainage passageway 42 and out the apertures 46, and thereby keep the contents of the tote 4 safe from moisture or water in operation.

In further embodiments, the main body 8 of the tote 4 may be adapted to have a wheeled portion (not shown) and/or an elongate handle (not shown) to facilitate easy transport of the tote assembly 2.

Figure 5:
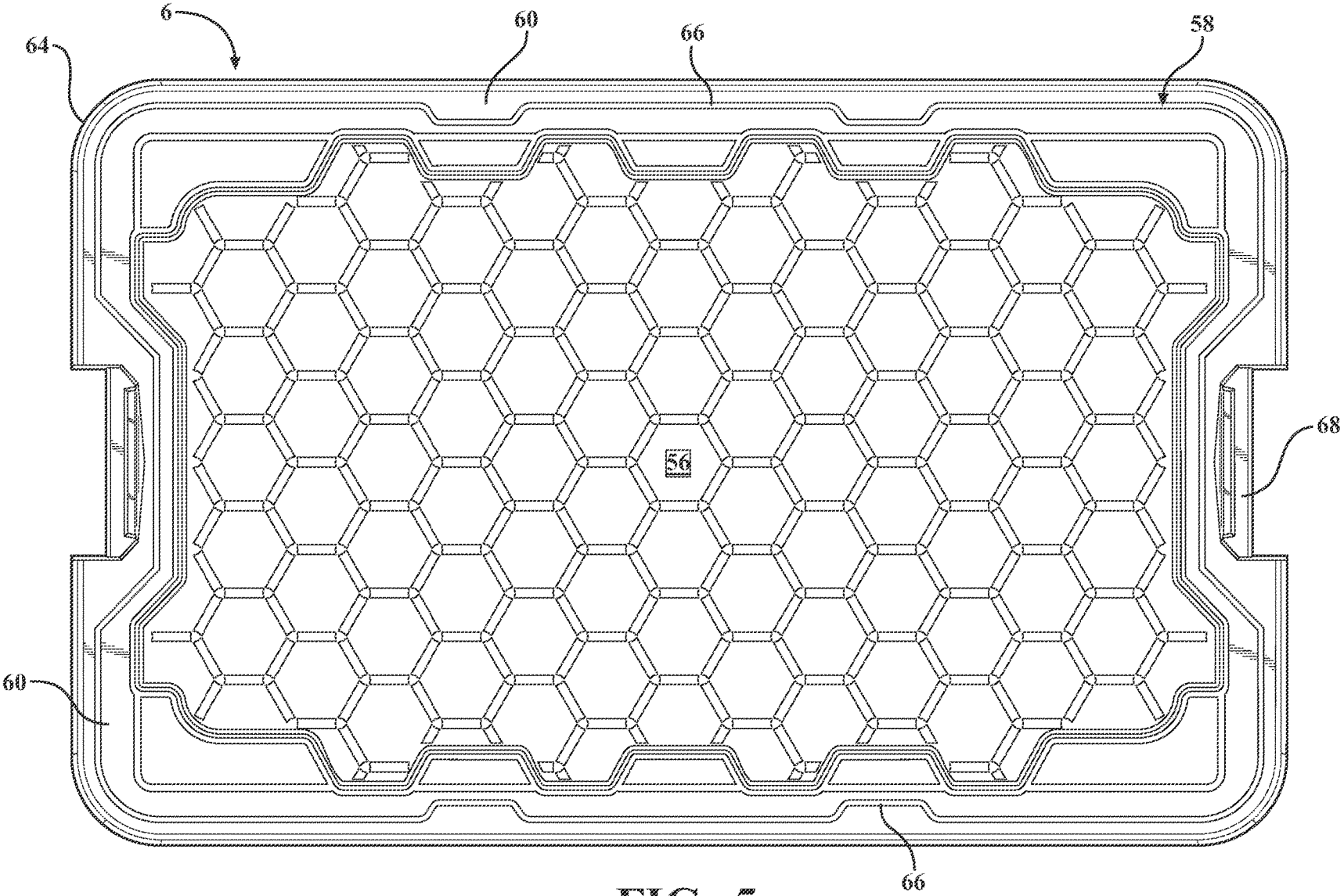
FIG. 5 is a top plan view of the lid of the tote assembly shown in FIG. 1, the lid shown without the tote.
Figure 6:
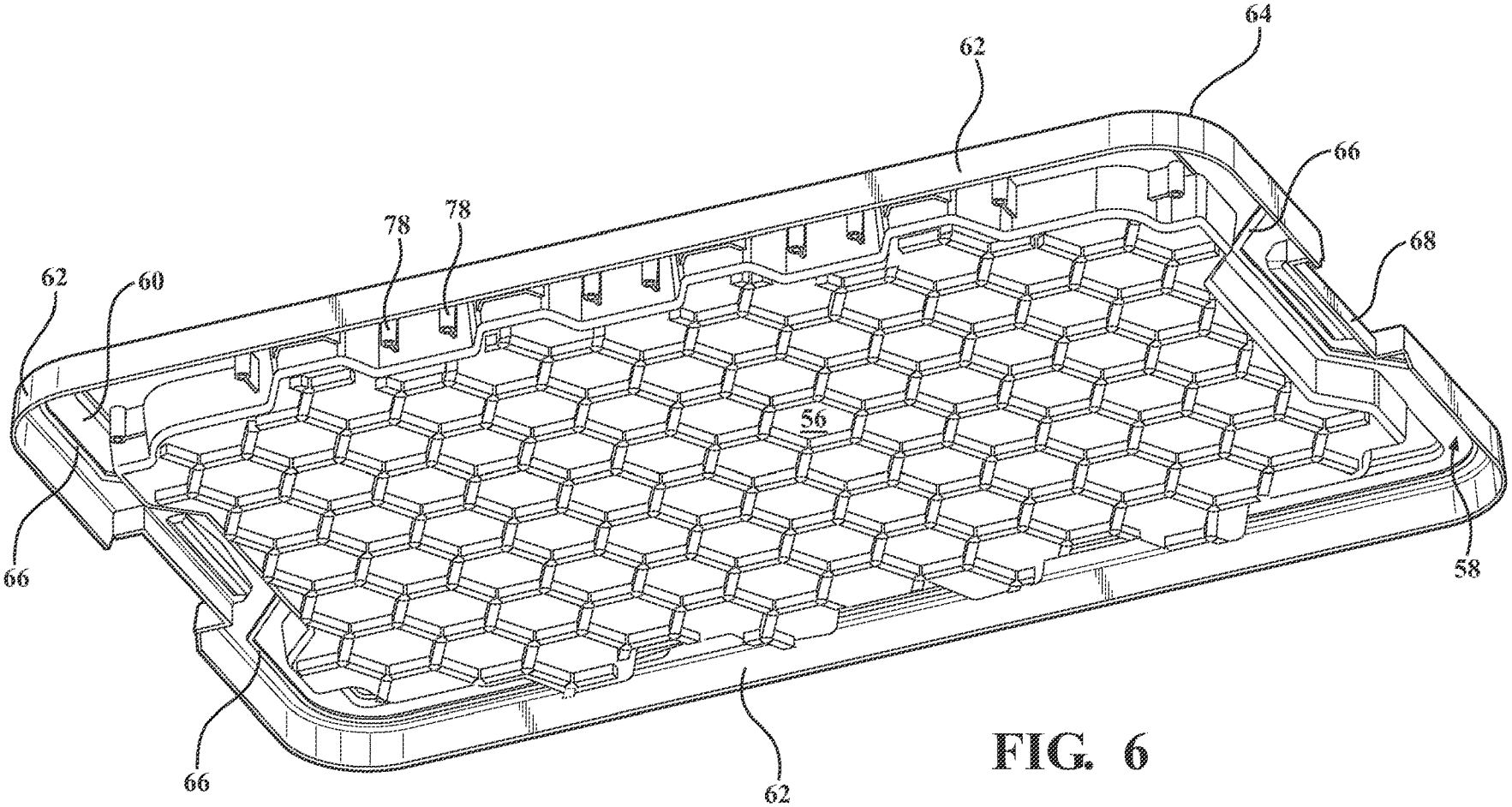
FIG. 6 is a bottom perspective view of the lid shown in FIG. 5, and further illustrating a sealing rib for cooperation with the sealing channel of the lid.

Referring now to FIGS. 5 and 6, the lid 6 of the tote assembly 2 has a center portion 56 and a collar 58 surrounding the center portion 56. The collar 58 has a top surface 60 and a side surface 62 that form a ledge 64. The ledge 64 is configured to provide an interference fit with the lip 20 of the tote 4 by surrounding the lip 20.

With continued reference to FIGS. 5 and 6, the top surface 60 of the collar 40 also includes a sealing rib 66 that extends around the top surface 60 of the collar 40. The sealing rib 66 forms a complete loop that corresponds with the loop defined by the sealing channel 32 of the tote 4. As shown in FIGS. 8 and 9, the sealing rib 66 is defined by a concave surface 65 formed in the top surface 60 of the collar 40, which likewise defines a convex surface 67 formed on the bottom surface of the collar 40. The concave surface 65 of the sealing rib 66 may have an arc shape, or have rounded or square corners, as nonlimiting examples.

As shown in FIGS. 8 and 9, the sealing rib 66 is configured to be disposed in the sealing channel 32 formed in the lip 20 of the tote 4. In specific embodiments, the sealing channel 32 and the sealing rib 66 form a fluid tight seal when the lid 6 is secured to the tote 4. In particular embodiments, the sealing rib 66 may have a width and a height that are substantially the same as a width and a height, respectively, of the associated sealing channel 32. In this manner, the sealing rib 66 may provide a friction fit with the sealing channel 32 which further assists in holding the lid 6 onto the tote 4, while also militating against leakage of penetration of moisture and water into the tote 4 where it could spoil or otherwise undesirably wet the contents in operation.

In certain embodiments, as shown in FIGS. 1, 5, and 6, the collar 58 of the lid 6 may include one or more lid handle portions 68. The lid handle portions 68 configured to connect to the tote handle portions 54. The tote and lid handle portions 54, 68 may include ridges 70 to improve gripping of the tote assembly 2 during transport. Additionally, in certain embodiments, one or more handle locks 72 may be used to lock the lid 6 to the tote 4. The handle locks 72 may permanently or semi-permanently connect to the lid 6 and the tote 4 to form the tote assembly 2. The handle locks 72 may include an arched portion 74 to allow for easy locking and unlocking of the lid 6 to the tote 4. Other suitable types of lid handle portions 68 and handle locks 72 may also be used within the scope of the disclosure.

It should be appreciated that multiple tote assemblies 2 may be stacked in a nested configuration (not shown). When in a nested position, the base wall 18 of a first tote assembly 2 abuts the center portion 56 of the lid 6 in a second tote assembly 2. As shown in FIGS. 1-3, the main body 8 of the tote 4 may have a plurality of side indentations 76, which facilitate the stacking of multiple tote assemblies 2. The side indentations 76 serve to increase the rigidity of the main body 8 by creating arches that direct a force placed on the lip 20 of the main body 8 toward the base wall 18. Accordingly, the side indentations 76 militate against a warping of the front wall 10, the rear wall 12, the first sidewall 14, and the second sidewall 16 of the main body 8. It should be appreciated that if the main body 8 of the tote 4 becomes warped, the lip 20 of the main body 8 may become undesirably bowed and cause an undesirable disconnection of the lid 6 from the tote 4. This likewise will negatively impact the substantially fluid-tight seal formed between the sealing channel 32 and the sealing rib 66, as described hereinabove.

With reference to FIG. 6, the lid 6 may also have a plurality of pylons 78 that further stabilize the tote assembly 2 in a nested configuration with another tote assembly 2. The pylons 78 may be disposed adjacent to the collar 40 and may be configured to fit within the indentations 76 formed in the main body 8. Any suitable appropriate size and shape of the side indentations 76 and the pylons 78 may be chosen by a skilled artisan within the scope of the present disclosure.

Additionally, the center portion 56 of the lid 6 may be oriented below the top surface 60 of the collar 58. The center portion 56 of the lid 6 disposed below the top surface 60 of the collar 58 improves stability when the tote assembly 2 is in a stacked position. The orientation of the center portion 56 creates a lower center of gravity for the nested tote assemblies 2, optimizing stability.

The tote assembly 2 may be manufactured using a variety of materials including plastic, wood, rubber, silicone, metal, such as aluminum or steel, cardboard, any combinations thereof, or any other suitable material chosen by a skilled artisan. In most particular examples, the tote assembly 2 is formed by injection molding a thermoplastic material such as polyethylene or polypropylene, as non-limiting examples. The material chosen may be selected to be fluid impermeable to further protect the contents of the tote 4. Other suitable manufacturing methods may also be employed.

Additionally, although the tote 4 and the lid 6 are shown as generally rectangular and symmetrical in shape, a skilled artisan may select any other suitable shape for the tote assembly 2, as desired. The tote assembly 2 can also be various sizes as well as may be selected by one of ordinary skill in the art.

In operation, the tote assembly 2 is configured to keep dry the contents of the main body 8 of the tote 4 in storage areas or environments prone to high moisture or the presence of water. After placing items in the cavity 24 of the tote 4, the lid 6 is placed on the tote 4 and an interference fit is created between the collar 58 of the lid 6 and the lip 20 of the tote 4. Where the interference fit is created, the sealing rib 66 of the lid 6 is disposed in the sealing channel 32 of the tote 4, thereby creating the fluid tight seal around the perimeter of the opening 22.

Where moisture or water accumulates between the lip 20 of the tote 4 and the collar 58 of the lid 6, each of the drains 34 further functions as a conduit to direct fluid away from the fluid tight seal. Specifically, the sloped edge 50 may direct the moisture or water away from the fluid tight seal formed between the sealing channel 32 and the sealing rib 66 and into the drainage passageway 42. More specifically, moisture or water is directed away from the fluid tight seal by the sloped edge 50 and into the opening 40 of the drain 34. The moisture or water continues along the drainage passageway 42 down the funneling wall 36 and toward the base wall 44 and through the aperture 46. The water is directed out of the aperture 46 and thereby exits the drain 34 without compromising the contents of the tote assembly 2.

It should be appreciated that the drains 34 of the present disclosure militates against undesirable accumulation of moisture or water between the lid 6 and the tote 4. Such undesirably accumulation of moisture or water might otherwise penetrate the fluid tight seal and enter the tote assembly 2, thereby wetting or spoiling the contents of the tote 4. Additionally, the drains 34 militate against the growth of mold between the lip 20 of the tote 4 and the collar 58 of the lid 6, which is optimal for storing items in moist or wet environments for long periods of time.

While certain representative embodiments and details have been shown for purposes of illustrating the invention, it will be apparent to those skilled in the art that various changes may be made without departing from the scope of the disclosure, which is further described in the following appended claims.

The invention claimed is:

1. A tote, comprising:

a hollow main body having a front wall, a rear wall, a first sidewall, a second sidewall, and a base wall, the hollow main body further having a lip extending laterally outwardly from the front wall, the rear wall, the first sidewall, and the second sidewall, the lip defining a perimeter of an opening at an end of the hollow main body, the opening disposed opposite the base wall, a sealing channel formed in the lip and extending around the perimeter of the opening, and at least one drain formed in the lip and adapted to direct a fluid away from the sealing channel, wherein the at least one drain includes a funneling wall extending downward from the lip and beyond a side surface of the lip, wherein a top surface of the lip has a sloping edge angled downwardly from the top surface toward the base wall to direct the fluid away from the sealing channel and down the funneling wall of the drain.

2. The tote of claim 1, wherein the at least one drain includes a drainage passageway and at least one aperture, the drainage passageway defined by a rim of an opening in the lip, the funneling wall extending downward from the rim, and a base wall opposite the rim having the at least one aperture formed therethrough.

3. The tote of claim 2, wherein the at least one aperture includes a plurality of the apertures spaced apart along a width of the base wall.

4. The tote of claim 3, wherein the drainage passageway includes a first partition and a second partition, the first partition and the second partition together with the funneling wall defining at least a first drainage passageway, a second drainage passageway, and a third drainage passageway, and the plurality of apertures including a first aperture, a second aperture, and a third aperture, the first drainage passageway having the first aperture, the second drainage passageway having the second aperture, and the third drainage passageway having the third aperture.

5. The tote of claim 1, wherein the at least one drain is positioned laterally outside of the sealing channel and a gap is formed between the hollow main body and the funneling wall.

6. The tote of claim 1, wherein the at least one drain includes at least one front drain, at least one rear drain, at least one first sidewall drain, the at least one front drain formed in a front section of the lip adjacent the front wall, the at least one rear drain formed in a rear section of the lip adjacent the rear wall, the at least one first sidewall drain formed in a first sidewall section of the lip adjacent the first sidewall, and the at least one second sidewall drain formed in a second sidewall section of the lip adjacent the second sidewall.

7. The tote of claim 1, wherein the sealing channel is defined by a concave portion of a top surface of the lip.

8. The tote of claim 1, wherein the sloping edge extends from the sealing channel to the at least one drain, the downward slope adapted to direct the fluid away from the sealing channel and into the at least one drain.

9. The tote of claim 1, further comprising at least one handle portion formed in the lip and positioned outside of the sealing channel.

10. A tote assembly, comprising:

a tote including a hollow main body having a front wall, a rear wall, a first sidewall, a second sidewall, and a base wall, the hollow main body further having a lip extending laterally outwardly from the front wall, the rear wall, the first sidewall, and the second sidewall, the lip defining a perimeter of an opening at an end of the hollow main body, the opening disposed opposite the base wall, a sealing channel formed in the lip and extending around the perimeter of the opening, and at least one drain formed in the lip and adapted to direct a fluid away from the sealing channel, wherein the at least one drain includes a funneling wall extending downward from the lip and beyond a side surface of the lip, wherein a top surface of the lip has a sloping edge angled downwardly from the top surface toward the base wall to direct the fluid away from the sealing channel and down the funneling wall of the drain; and a lid having a main body with a center portion, a collar, and a sealing rib, the collar disposed around the center portion and forming a perimeter of the lid, the collar having a top surface, a bottom surface, and a side surface, the side surface of the collar extending downwardly from the top surface, and the sealing rib formed in the collar and extending around the perimeter of the lid, wherein the collar forms an interference fit with the lip of the tote, and wherein the sealing rib is disposed in the sealing channel and forms a fluid tight seal therebetween.

11. The tote assembly of claim 10, wherein the at least one drain includes, a drainage passageway and at least one aperture, the drainage passageway defined by a rim of an opening in the lip, the funneling wall extending downward from the rim, and a base wall opposite the rim having the at least one aperture formed therethrough.

12. The tote assembly of claim 11, wherein the at least one aperture includes a plurality of the apertures spaced apart along a width of the base wall.

13. The tote assembly of claim 12, wherein the drainage passageway includes a first partition and a second partition, the first partition and the second partition together with the funneling wall defining at least a first drainage passageway, a second drainage passageway, and a third drainage passageway, and the plurality of apertures including a first aperture, a second aperture, and a third aperture, the first drainage passageway having the first aperture, the second drainage passageway having the second aperture, and the third drainage passageway having the third aperture.

14. The tote assembly of claim 10, wherein the at least one drain is positioned laterally outside of the sealing channel.

15. The tote assembly of claim 10, wherein the at least one drain includes at least one front drain, at least one rear drawing, at least one first sidewall drain, the at least one front drawing formed in a front section of the lip adjacent the front wall, the at least one rear drain formed in a rear section of the lip adjacent the rear wall.

16. The tote assembly of claim 15, wherein the at least one first sidewall drain formed in a first sidewall section of the lip adjacent the first sidewall, and the at least one second sidewall drain formed in a second sidewall section of the lip adjacent the second sidewall.

17. The tote assembly of claim 10, wherein the sealing channel is defined by a concave portion of a top surface of the lip, and the sealing rib is defined by a convex portion of the bottom surface of the collar.

18. The tote assembly of claim 10, wherein the sloping edge extends from the sealing channel to the at least one drain, the downward slope adapted to direct the fluid away from the sealing channel and into the at least one drain.

* * * * *